US008746477B2

(12) United States Patent
Dagesse

(10) Patent No.: US 8,746,477 B2
(45) Date of Patent: Jun. 10, 2014

(54) TANK FORMED FROM PANELS OF COMPOSITE MATERIAL

(75) Inventor: Paul Dagesse, Winnipeg (CA)

(73) Assignee: Rhinokore Composites Manufacturing Partnership, Calgary (CA)

( * ) Notice: Subject to any disclaimer, the term of this patent is extended or adjusted under 35 U.S.C. 154(b) by 13 days.

(21) Appl. No.: 13/213,284

(22) Filed: Aug. 19, 2011

(65) Prior Publication Data

US 2012/0031899 A1 Feb. 9, 2012

Related U.S. Application Data

(63) Continuation-in-part of application No. 12/783,805, filed on May 20, 2010, now abandoned.

(60) Provisional application No. 61/219,045, filed on Jun. 22, 2009.

(51) Int. Cl.
*F16B 7/00* (2006.01)

(52) U.S. Cl.
USPC ..... 220/4.17; 220/4.16; 220/4.12; 220/4.28

(58) Field of Classification Search
USPC ..... 220/4.12, 4.13, 4.28, 4.33, 565, 1.6, 220/646, 647, 4.17, 4.16
See application file for complete search history.

(56) References Cited

U.S. PATENT DOCUMENTS 749,199 A * 1/1904 Jones ..... 220/668
2,430,200 A 11/1947 Wilson
3,007,597 A * 11/1961 Morrison ..... 220/592.2
3,348,459 A 10/1967 Harvey
3,409,916 A * 11/1968 Billig et al. ..... 52/146
3,429,473 A * 2/1969 Vroman et al. ..... 220/565
3,564,801 A 2/1971 Huerta
3,602,110 A 8/1971 Wiggins
3,694,983 A 10/1972 Couquet
3,729,889 A * 5/1973 Baruzzini ..... 52/264
3,859,000 A 1/1975 Webster
4,050,605 A * 9/1977 Wakana et al. ..... 220/565
4,558,797 A * 12/1985 Mitchell ..... 220/668
4,703,597 A 11/1987 Eggemar
4,845,907 A 7/1989 Meek
4,964,252 A * 10/1990 Guliker ..... 52/275
5,032,037 A 7/1991 Phillips et al.
5,582,311 A * 12/1996 Bartenstein et al. ..... 220/4.12
5,765,707 A * 6/1998 Kenevan ..... 220/4.28
5,797,237 A 8/1998 Finkell, Jr.
5,971,655 A 10/1999 Shirakawa
6,652,183 B2 11/2003 Stasiewich et al.

(Continued)

*Primary Examiner* — Stephen Castellano
(74) *Attorney, Agent, or Firm* — Wong, Cabello, Lutsch, Rutherford & Brucculeri, LLP.

(57) ABSTRACT

A tank is formed from panels fastened together edge to edge to form four upstanding side walls and base panels where across the base the panels extend from one side to the other. The panels are composite and formed from a honeycomb core panel with a foam material filling the tubular cells and a fibrous reinforcing cover sheets. The walls are supported by a metal frame including a base member extending along the wall at the bottom of the panels and a plurality of joining members connected to the base member and upstanding therefrom for holding the ends of the panels in end to end relationship. Cables extend along the walls adjacent the base member and connect to end posts of the walls. A series of posts stand along the walls on the outside and are connected across the tank by cables extending over the top edge of the walls.

10 Claims, 7 Drawing Sheets

(56) References Cited

U.S. PATENT DOCUMENTS

| | | | | |
|---|---|---|---|---|
| 6,676,785 | B2 | 1/2004 | Johnson et al. | |
| 7,415,741 | B1 | 8/2008 | Wasley et al. | |
| 7,608,313 | B2 | 10/2009 | Solomon et al. | |
| 7,641,963 | B2 | 1/2010 | Grafenauer | |
| 2003/0047561 | A1* | 3/2003 | Neto | 220/1.6 |
| 2003/0233809 | A1 | 12/2003 | Pervan | |
| 2007/0250025 | A1 | 10/2007 | Sams et al. | |
| 2009/0142542 | A1 | 6/2009 | Halahmi et al. | |
| 2009/0286043 | A1 | 11/2009 | De Baets et al. | |

* cited by examiner

TANK FORMED FROM PANELS OF COMPOSITE MATERIAL

This application is a continuation in part of application Ser. No. 12/783,805 filed May 20, 2010 now abandoned.

This application claims the benefit under 35 U.S.C. 119 of Provisional Application No: 61/219,045 filed Jun. 22, 2009.

This invention relates to a tank formed from one or more panels of a composite material.

This application relates to the panel disclosed and claimed in application Ser. No: 12/355,827 filed Jan. 19, 2009 now issued as Patent INSERT which corresponds to Canadian application 2,639,673 filed Oct. 22, 2008. The panel used herein can be of the type disclosed in the above application or other composite panels can be used.

BACKGROUND OF THE INVENTION

A panels of the above application provide an effective very strong construction with significantly greater rigidity against bending than previous composite panels.

This has allowed the manufacture of tanks from the panels which can accommodate the high forces arising from contained liquids within the tank.

This construction can provide a tank of very large dimensions such as 120 feet×40 feet×8 feet for containing a very large body of water for example as a tank used for hydraulic fracturing of natural gas wells, generally known as "frac tanks". The advantage of using the composite panels is that they provide a high level of insulation to the tank which avoids or reduces heating costs to prevent freezing of the water in cold climates. The insulation can be supplemented by floating further panels on the surface.

SUMMARY OF THE INVENTION

It is one object of the invention to provide a tank manufactured from composite panels.

According to one aspect of the invention there is provided a tank for containing a liquid comprising:

at least one elongate tank wall;

the tank wall being formed by a plurality of wall panels arranged end to end along the tank wall;

each wall panel being formed of a composite material including inner and outer sheets and an intermediate core;

a metal frame for holding the panels in the tank wall including:

a base member extending along the wall at the bottom of the panels;

and a plurality of joining members connected to the base member and upstanding therefrom for holding the ends of the panels in end to end relationship;

and a liner on an inside surface of the panels to hold a liquid contained by the wall.

Preferably there is provided a tension member extending along the tank wall applying a longitudinal tension to the panels to hold them end to end.

Preferably the tension member such as a cable is arranged closely adjacent and outwardly of the base member.

Preferably the tank includes at least two planar walls each formed from a plurality of planar panels where the two walls are connected at a corner. However cylindrical tanks using curved panels can also be manufactured using this process.

Preferably there is provided a corner post having two channel members each having a base and two sides for receiving an edge of an end one of the panels of the respective wall and wherein one channel is offset along its wall from the other to expose a part of the base of the other channel.

Preferably there is provided at the corner post a bracket member for holding two tension members each extending along a respective one of the walls and wherein the bracket member includes respective portions thereof butting the bases of the channels to apply force thereto.

Preferably there are provided inclined support braces at spaced positions along the wall and each associated with a respective one of the joining members.

Preferably the panels are unsupported by the frame along the top edge of the panels.

Preferably there is provided a plurality of upstanding posts at spaced positions along the wall and exterior to the wall post with a bottom of each post connected to the base member.

Preferably the posts are attached to a top wall engagement member for locating the post at the top edge of the wall and wherein there is provided a longitudinal tension member which extends from the post over the top edge of the panel at right angles to the wall for engaging a spaced parallel wall of the tank.

Preferably the top wall engagement member comprises an inverted channel and a receiving member for engaging and locating the post.

Preferably there is provided a plurality of parallel base panels arranged to lie on a ground surface inside said at least one wall with an edge of each panel at the base member of the wall.

Preferably the base member includes a channel for receiving end edges of the base panels.

Preferably the parallel base panels are connected side edge to side edge by connecting members at spaced positions along the side edges.

Preferably there is provided at each joining member a connecting member extending transverse to the wall from a position outside the wall to a position inside the wall and connecting the side edges of the base panel inside the wall and including a brace extending from the connecting member outside the wall to the wall to hold the wall at right angles to the connecting member.

Preferably the tank comprises four walls arranged in a rectangular arrangement of a first pair of parallel walls and a second pair of parallel walls connected at four corners and wherein there is provided a plurality of parallel base panels lying on the ground.

In this arrangement, preferably the base panels span across between the first pair of walls so as to have end edges of the base panels arranged at each of the first pair.

In this arrangement, preferably each of the walls has at spaced positions therealong a plurality of posts mounted outside the walls and each having a top wall engagement member for locating the post at the top edge of the wall and wherein there is provided a longitudinal tension member which extends from the post over the top edge of the panel at right angles to the wall for engaging a corresponding post of the spaced parallel wall of the respective pair.

In this arrangement, preferably the second pair of walls are formed from a single panel extending along the full length of the wall and the first pair of walls includes a plurality of panels arranged end to end.

In this arrangement, preferably the base panels are connected edge to edge by edge connecting members at spaced position therealong where the connecting members are arranged so as to be located at positions aligned with the tension members spanning the second pair of walls.

Preferably the panel member is of the above type comprising a honeycomb core panel having a first face and a second opposite face with an array of generally hexagonal tubular cells defined by walls of the core panel extending between the first and second faces;

a foam material filling the tubular cells;

a first fibrous reinforcing cover sheet extending over the first face of the core panel;

a second fibrous reinforcing cover sheet extending over the second face of the core panel;

the first and second cover sheets being filled with a set resin material;

wherein the walls of the honey comb core panel are formed from a porous fibrous material;

and wherein the set resin in the cover sheets extends from the cover sheets into the porous fibrous material of the walls of the core panel so as to form an integral structure of the resin extending between the walls and the sheets.

In one arrangement the tank may be rectangular. In this case the tank is formed from a plurality of panels arranged edge to edge.

The panel members can be connected edge to edge by an adhesive or by channel members into which an edge of the panel is inserted.

In another arrangement the tank may have a cylindrical wall and at least one circular end wall.

In this case the circular end wall can be formed of a single panel member and the cylindrical wall is formed of one or more curved panel members.

Thus the cylindrical wall can be formed of a single peripheral panel member with the first cover sheet defining an inner surface of the tank and the second cover sheet defining an outer surface of the tank.

Preferably the walls of the honey comb core panel are formed from a porous fibrous material and the set resin in the cover sheets extends from the cover sheets into the porous fibrous material of the walls of the core panel so as to form an integral structure of the resin extending between the walls and the sheets.

Preferably the resin substantially fills the material of the core walls and preferably the resin extends through the core walls from the first sheet to the second sheet. However the first intention is that the resin acts firstly to form an integral connection between the layer defined by the face sheets and the core walls so as to provide and increased resistance to shear forces tending to delaminate the structure at the junction between the sheet and the core. Hence, it will be appreciated that, in order to achieve this requirement, the resin may not extend fully through the structure to form the tubular reinforcement. Thus other resins can be used in the core material provided they do not interfere with the formation of the integral connection.

Secondly the intention is that the resin forms an increased compression resistance in the core panel by forming a series of resin reinforced tubes through the panel at the walls. Hence, it will be appreciated that, in order to achieve this requirement, the resin may not extend fully into each and every pore or space in the walls but the resin will extend into the structure sufficiently to form the integral connection at the sheets and the tubular reinforcement extending through the panel.

It will be appreciated that the walls generally do not contain any existing resin filling material when the resin introduction occurs since this will prevent or inhibit the penetration of the resin into the walls and the formation of the tubular structures through the panel and the integral connection to the sheets. However the walls may contain some reinforcing resin provided it does not prevent the formation of the integral connection.

Preferably the resin is a thermosetting resin such as thermosetting polyester. However other types of resin can be used such as polyurethane or epoxy, vinyl ester, phenolic resin.

Preferably the walls are connected each to the next to form the honeycomb panel by a heat seal. This is preferred as the heat seals are less likely to interfere with the entry of the resin during the resin introduction process and are easier to effect and less expensive. However adhesive connection may be used.

Preferably the walls are formed from a non-woven fibrous material such as a spun bond fibrous plastics material. However the material selected can be of any construction provided it is porous so as to allow the penetration of the resin during the resin introduction step. Thus of course aluminum and plastics film cannot be used. The material should also bond to the foam during the foam filling step. The compressive strength of the material in the honeycomb construction is of less importance and can be quite low in comparison with other materials, such as those conventionally used, provided it is sufficient to allow the foam filling step to occur.

Preferably the sheets contain glass reinforcing fibers as these are inexpensive and are known to provide the required strength characteristics. However other reinforcing fibers can be used.

While the term "honeycomb" is used generally and in this document it will be appreciated that the tubular cells formed are generally not accurately hexagonal in cross section, particularly where, as described herein, the cells are formed from a porous fibrous material without reinforcing resin available during the filling process to maintain a regular shape of the cells.

The manufacture of panels in the manner set forth above allows the formation of panels which can be as much as 8 feet×40 feet and either 3 inches or 6 inches thick for different levels of insulation. In this way a tank can be manufactured using the panels with a width formed by one panel of 40 feet and a length formed by several panels arranged end to end. Base panels of the same length can be used to cover the ground with each panels spanning across the width.

BRIEF DESCRIPTION OF THE DRAWINGS

One embodiment of the invention will now be described in conjunction with the accompanying drawings in which.

DETAILED DESCRIPTION

Figure 1:
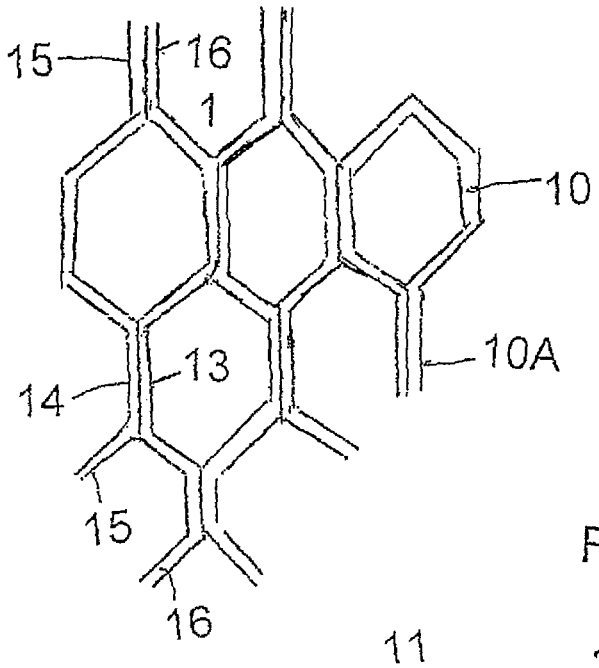
FIG. 1 is horizontal cross sectional view through a panel to be used in the present invention.
Figure 2:
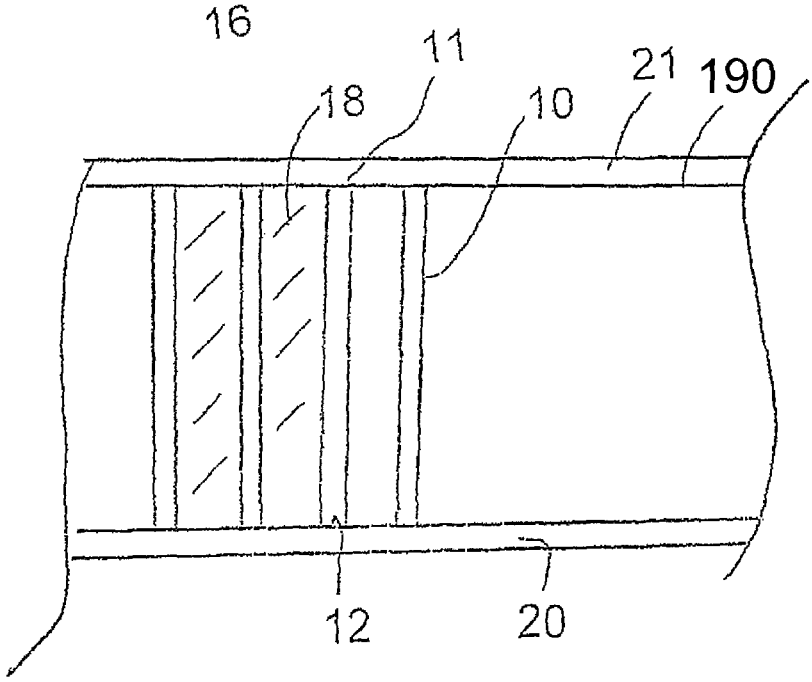
FIG. 2 is a vertical cross sectional view through the panel of FIG. 1.

The composite panel described in general above is shown in FIGS. 1 and 2 and is formed by a honeycomb core panel 100 having a first face 210 and a second opposite face 220 with an array of generally hexagonal tubular cells 120 defined by walls of the core panel 100 extending between the first and second faces 210, 220. The cells are formed from strips 130A, 130B arranged side by side of a porous fibrous material which is heat sealed at a sealing line 140 to define the generally hexagonal cells.

A foam material such as a polyurethane foam 230 fills the tubular cells. A first fibrous reinforcing cover sheet 240A such as a fiberglass mat (or carbon fiber, aramid fiber, Kevlar fiber, polyester fiber, natural fiber — e.g. hemp, flax, straw) extends over the first face 210 of the core panel 100 and a second fibrous reinforcing cover sheet 240B extends over the second face 220 of the core panel 100.

The first and second cover sheets 240A, 240B are filled with a set resin material 250 which extends from the cover sheets 240A, 240B into the porous fibrous material of the walls 130A, 130B of the core panel 100 so as to form an integral structure of the resin extending between the walls 130A, 130B and the sheets 240A, 240B.

Figure 3:
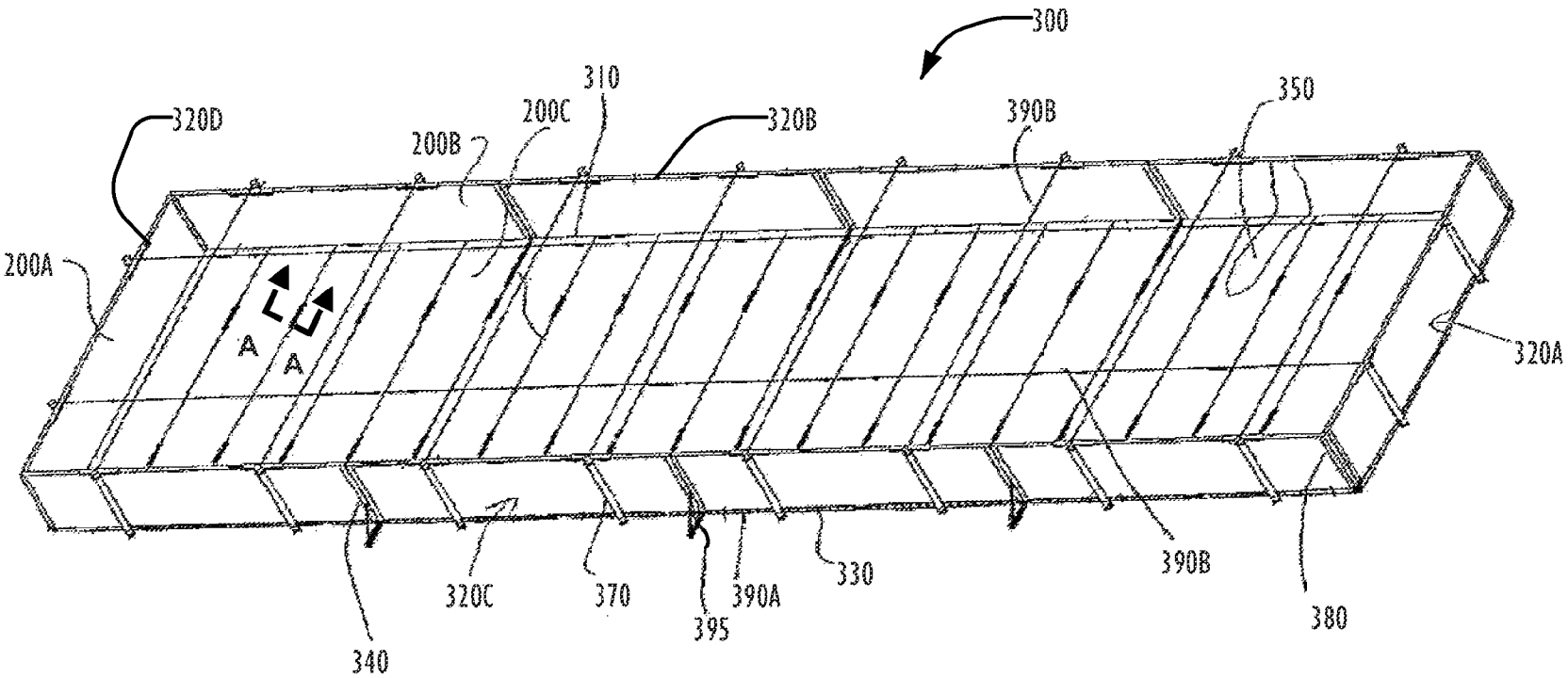
FIG. 3 is an isometric view of a tank according to the present invention.

In FIG. 3 is shown a tank 300 which is rectangular and is formed from a plurality of panels 200A to 200C. The tank 300 is formed from two pairs of parallel walls 320A, 320D and 320B, 320C connected at four corners to form a rectangular tank 300. The walls 320A, 320D are formed by single panels 200 spanning the full length of the wall. The walls 320B, 320C are formed by a plurality of panels 200B arranged end to end along the wall. The tank 300 is completed by base panels 200C lying on the ground which also span the space between the walls 320B and 320C so that the panels 200C have end edges 310 at the walls 320B and 320C.

Thus the tank walls 320A, 320B are formed by a plurality of wall panels 200B arranged end to end along the tank wall. Each wall panel 200A, 200B, 200C is formed of a composite material including inner and outer sheets and an intermediate core as previously described.

There is also provided a metal frame for holding the panels together to form the construction of the tank and particularly each tank wall. The frame structure includes a base member 330 extending along the wall at the bottom of the panels, and a plurality of joining members 340 connected to the base member 330 and upstanding therefrom for holding the ends of the panels 200 in end to end relationship. In order to hold liquid, particularly water, without escaping between the panels and the frame there is provided a conventional liner schematically indicated at 350 on an inside surface of the base panels 200C and up the wall panels 200A, 200B over a top edge of the wall panels 200A, 200B to hold a liquid contained by the wall.

The frame further includes a plurality of corner members 380 each arranged at a respective corner between two walls.

Figure 13:
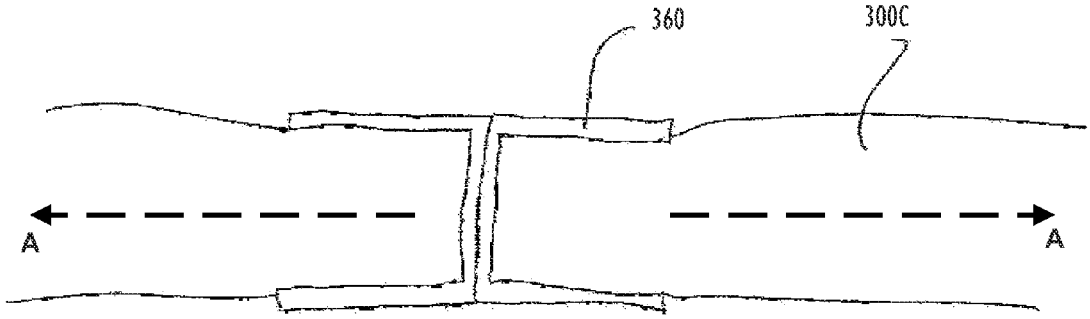
FIG. 13 is a cross-sectional view along the lines 13-13 of the tank of FIG. 3.

The base panels 200C are connected and held edge to edge by grade beam elements 360 which are H-shaped in cross-section as shown in FIG. 13 to receive in the two channels thus defined the edges of the adjacent panels 200C. The grade beam elements 360 include outer portions 360A and 360B at the walls 320B and 320C together with intermediate portions 360C and 360D. The portions 360C and 360D are located at each space between two adjacent panels whereas the portions 360A and 360B are located only at the joining members 340.

Each wall is associated with a plurality of posts 370 at spaced positions along the length of the wall. Thus the walls 320A and 320D have only two posts spaced from one another and from the corner members 380. Thus each wall 320B and 320C has a series of posts 370 with each panel 200B having two posts 370 making a total of eight posts 370 for the four panels 200B with again the posts 370 being spaced from one another and from the corner members 380 and from the joining members 340.

Each wall has provided a tension member or cable 390A extending along the tank wall at the base of the posts 370 and closely adjacent the base member 330 applying a longitudinal tension to the panels to hold them end to end.

Figure 8:
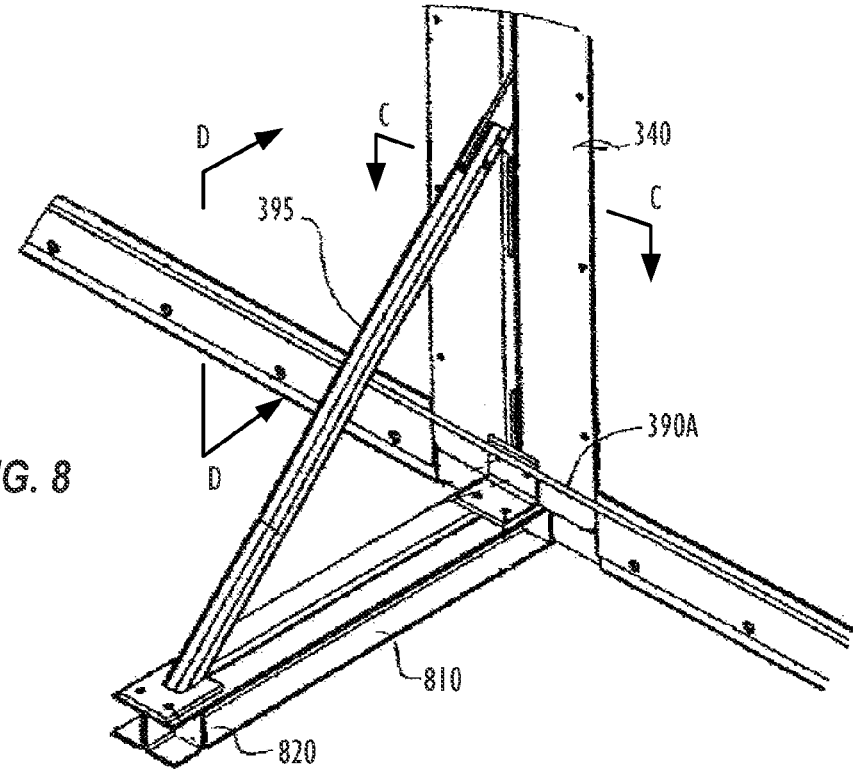
FIG. 8 is an isometric view of one joining member between two panels of the wall of the tank of FIG. 3.
Figure 9:
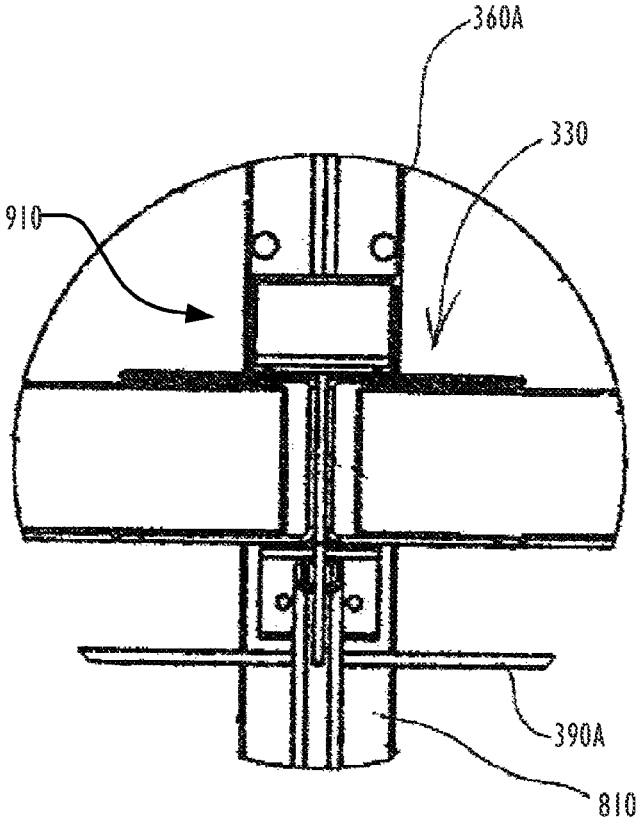
FIG. 9 is a cross-sectional view along the lines 9-9 of FIG. 8 of the tank of FIG. 3.

Also each post 370 corresponds in position to an associated post at the opposite wall and a tension member or cable 390B spans across the tank 300 between the two associated posts 370 to apply a tension across the tank 300. As best shown in FIGS. 8 and 9, the tension member or cable 390A is arranged closely adjacent and outwardly of the base member 330 and extends past each joining member 340 along the full length of the wall for connection to the respective corner members 380.

Figure 6:
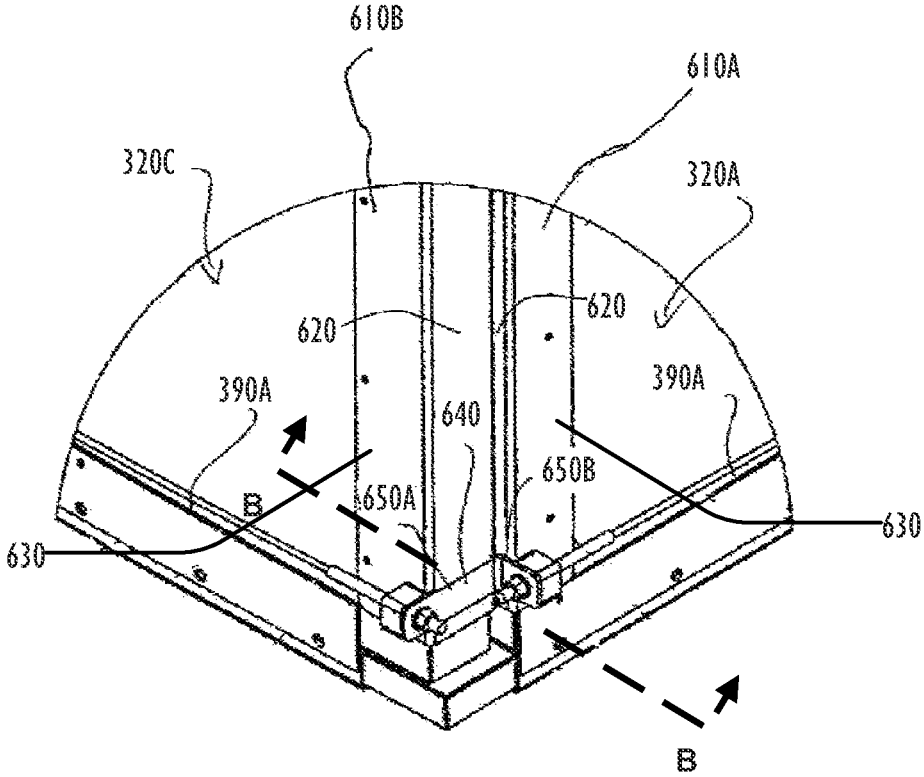
FIG. 6 is an isometric view of one corner post of the tank of FIG. 3.
Figure 7:
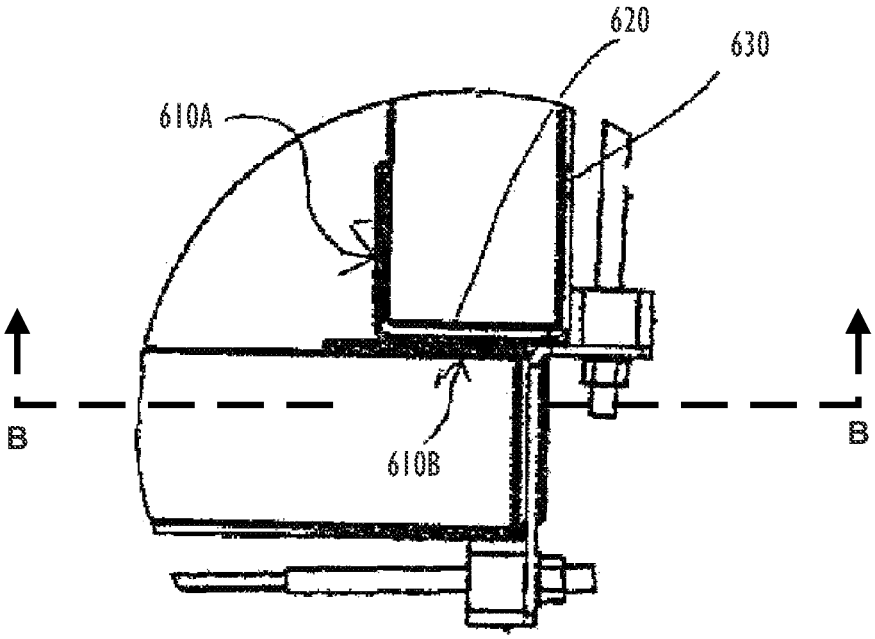
FIG. 7 is a cross-sectional view along the lines 7-7 of FIG. 6 of the tank of FIG. 3.

As shown best in FIGS. 6 and 7, each corner post 380 has two channel members 610A and 610B each having a base 620 and two sides 630 for receiving an edge of an end one of the panels 200 of the respective wall and wherein one channel 610B is offset along its wall from the other 610A to expose a part of the base 620 of the other channel 610A. This allows at the corner post 380 a bracket member 23E to be connected for holding two tension members 390A each extending along a respective one of the walls 320C, 320A. This shaping of the corner member 380 allows wherein the bracket member 640 to include respective portions 650A and 650B thereof butting the bases 620 of the channels 610A and 610B to apply force thereto in the direction along the wall.

As best shown in FIGS. 3 and 8, there are provided inclined support braces 395 at spaced positions along the walls 320B and 320C and each associated with a respective one of the joining members 340. At each joining member 340 there is provided a connecting member 810 extending transverse to the wall 320C from a position 820 outside the wall to a position 910 inside the wall where it forms the grade beam 360A. As previously stated, the beam 360A acts to connect the side edges of the base panel 200C inside the wall. The connecting member 810 is thus a rigid structure extending under the wall from the outer portion 820 into the grade beam 360A as an integral member to provide stability to the wall against tilting and lifting. The outer portion 820 is connected to the brace 395 extending from the connecting member 810 outside the wall to the wall at the joining member 340 to hold the wall at right angles to the connecting member 810.

Figure 10:
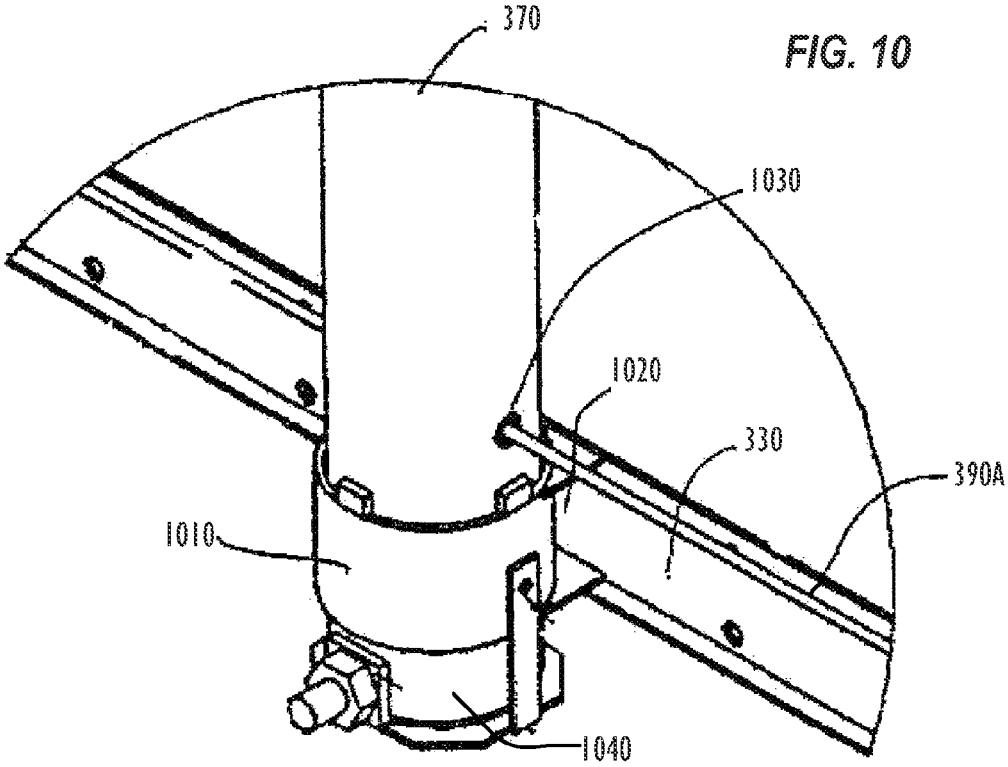
FIG. 10 is an isomeric view of the bottom end of one post of the wall of the tank of FIG. 3.
Figure 11:
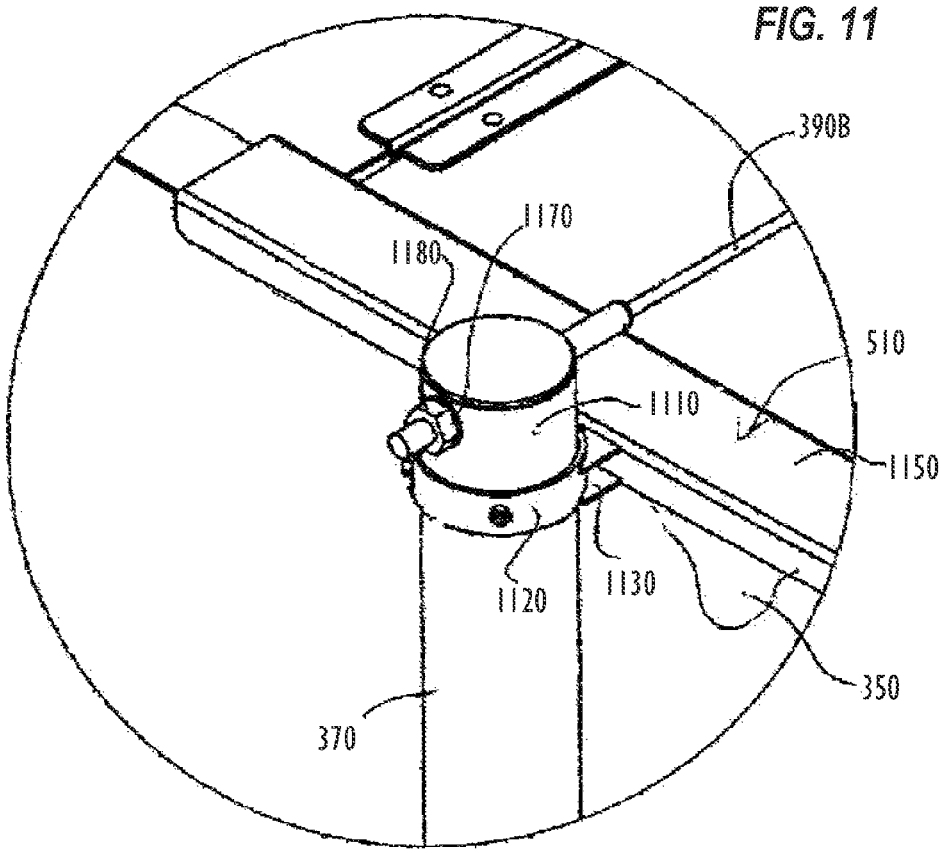
FIG. 11 is an isometric view of the top end of one post of the wall of the tank of FIG. 3.
Figure 12:
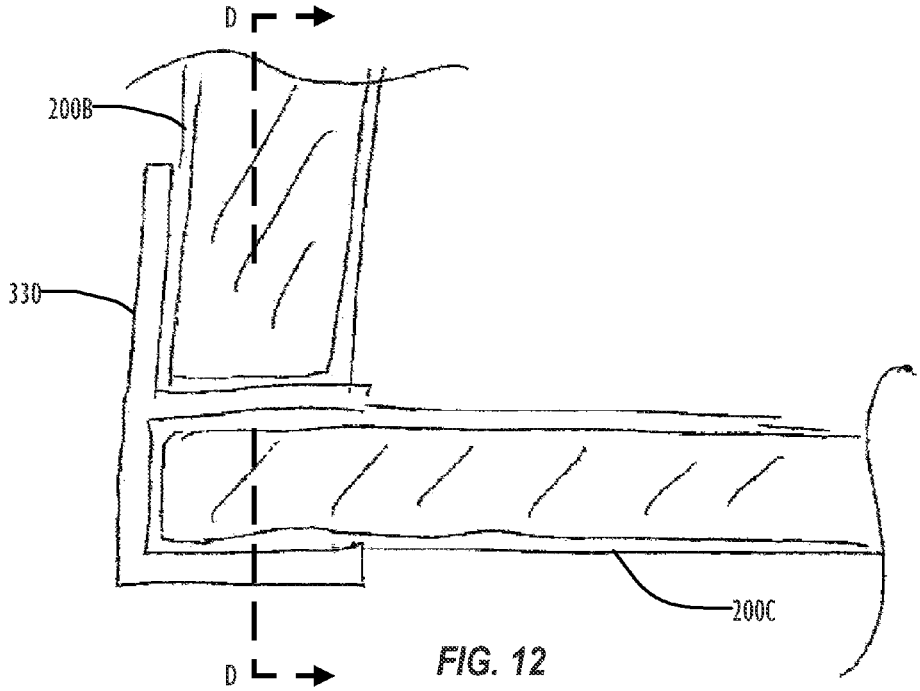
FIG. 12 is a cross-sectional view along the lines 12-12 of FIG. 8 of the tank of FIG. 3.

The cylindrical posts are best shown in FIGS. 10 and 11 and are located at spaced positions along the wall and exterior to the wall. A bottom end 1040 of each post 370 is connected to the base member 330 by a circular collar 1010 attached at one side 1020 to the outer wall of the rail forming the base member 330. This holds the post 370 fixed to the rail 330. The cable 390A extends through a hole 1030 at the bottom of the post 370 so as to be located by the posts 370 along the outside of the wall to prevent distortion of the cables 390A away from the wall.

As shown in FIG. 11, the upper end 1110 of the posts 370 are attached to a top wall engagement member 1140 for locating the post 370 at the top edge of the wall. The top wall engagement member 1140 comprises an inverted channel 1150 which sits over the top edge of the panel and a receiving collar 1120 for engaging and locating the upper end 1110 of the post 370. The collar 1120 is welded to one side of the channel 1150 at bracket 1130 so that the collar 1120 is held against movement relative to the top edge of the panel. A longitudinal tension member 390B extends through a hole 1170 in the post 370 and is held there by a screw coupling 1180. The cable 390B therefore extends from the post 370 over the top edge of the panel over the channel 1150 in a direction at right angles to the wall for engaging the associated post 370 at the opposite spaced parallel wall of the tank 300.

Figure 4:
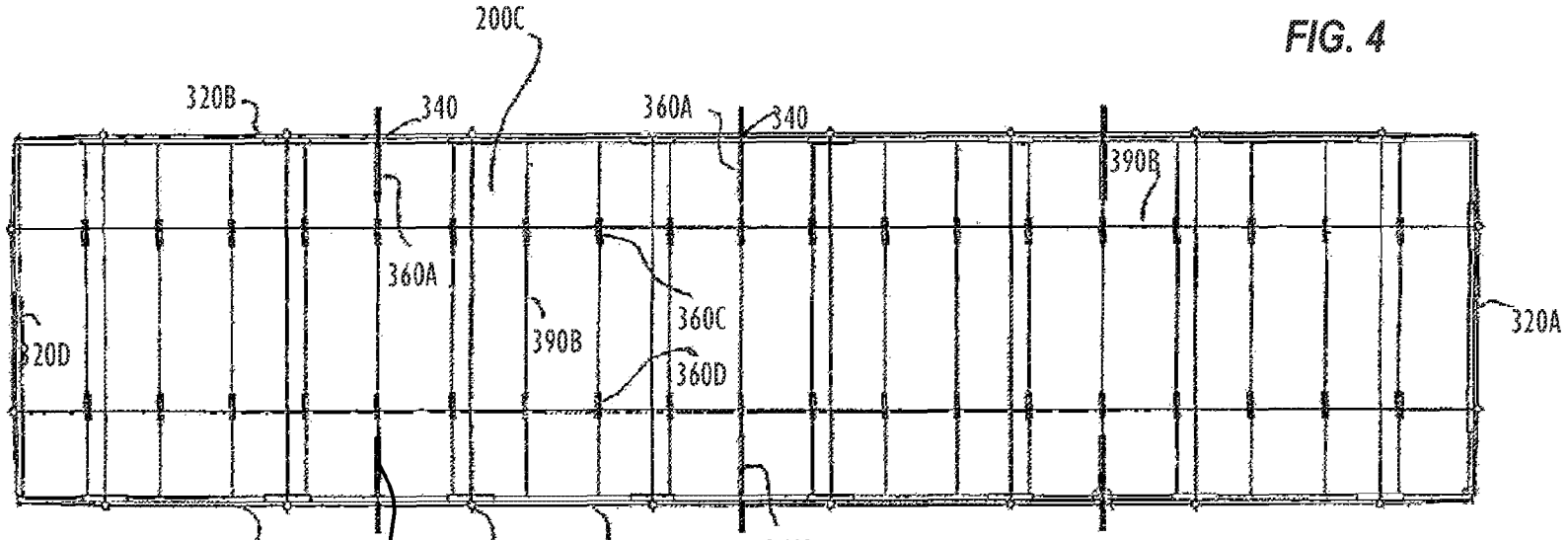
FIG. 4 is a top plan view of the tank of FIG. 3.
Figure 5:
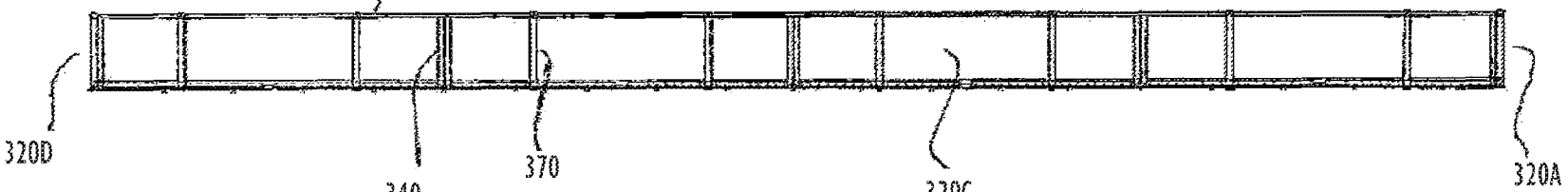
FIG. 5 is a side elevational view of the tank of FIG. 3.

As shown in FIG. 4, the cables 390A extending longitudinally along the tank 300 between the walls 320D and 320A and parallel to the walls 320B and 320C are positioned on the posts 370 so that the connecting members 360A are arranged so as to be located at positions aligned with the cable 390A. This ensures that the tension applied by the cables 390A is applied onto the structure at a position where the base panels 200C are held against relative movement by the connecting members 360A.

The wall panels 200A, 200B are unsupported by the frame along the top edge of the panels 200A, 200B so that there is no requirement for any structural connections at this location.

The channels 1140 (FIG. 11) are sufficient to communicate forces from the cables 390B and the posts 370 to the top of the wall and also to act as hold down members for the top edge of the liner 350 which extends over the top of the wall and drapes down the outside surface of the wall panels to a length sufficient to prevent the liner from being pulled out.

The invention claimed is:

1. A tank for containing a liquid, the tank comprising:

at least two elongate tank walls formed from one or more wall panels;

one or more base panels, each wall panel and each base panel being formed of a composite material including inner and outer sheets and an intermediate insulating core;

and a liner adjacent to said inner sheets of the panels to hold a liquid contained by the tank, wherein adjacent tank walls are connected at a corner post having two channel members each having a base and two sides for receiving an edge of an end of a panel of the respective wall and wherein one channel is offset along its wall from the other to expose a part of the base of the other channel, wherein there is provided at the corner post a bracket member for holding two tension members, each extending along a respective one of the walls, and wherein the bracket member includes respective portions thereof butting the bases of the channels to apply force thereto.

2. The tank according to claim 1 wherein there is provided a tension member extending along the tank walls.

3. The tank according to claim 2 wherein the tension member is arranged closely adjacent and outwardly of the base panel.

4. The tank according to claim 1 wherein there is provided a plurality of upstanding posts at spaced positions along the walls and exterior to the walls with a bottom of each post connected to the base panel.

5. The tank according to claim 4 wherein the posts are attached to a top wall engagement member for locating the post at a top edge of the corresponding wall and wherein there is provided a lateral tension member which extends from the post over a top edge of the panel at right angles to the corresponding wall for engaging a spaced parallel wall of the tank.

6. The tank according to claim 5 wherein the top wall engagement member comprises an inverted channel and a receiving member for engaging and locating the post.

7. The tank according to claim 1 wherein the tank comprises four walls arranged in a rectangular arrangement of a first pair of parallel walls and a second pair of parallel walls connected at four corners and wherein there is provided a plurality of parallel base panels lying on the ground.

8. The tank according to claim 7 wherein each of the walls has at spaced positions therealong a plurality of posts mounted outside the walls and each having a top wall engagement member for locating the post at a top edge of the wall and wherein there is provided a lateral tension member which extends from the post over a top edge of the panel at right angles to the wall for engaging a corresponding post of the spaced parallel wall of the respective pair.

9. The tank according to claim 8 wherein each of the second pair of parallel walls is formed from a single panel extending along the full length of the wall and each of the first pair of parallel walls includes a plurality of panels arranged end to end.

10. The tank according to claim 9 wherein the base panels are connected edge to edge by edge connecting members at spaced position therealong where the edge connecting members are arranged so as to be located at positions aligned with the tension members spanning the second pair of walls.

* * * * *